US005442255A

United States Patent [19]

Ise et al.

[11] Patent Number: 5,442,255

[45] Date of Patent: Aug. 15, 1995

[54] ELECTRON EMITTING DEVICE

[75] Inventors: Tomokazu Ise, Abiko; Reiko Imamoto, Kashiwa, both of Japan

[73] Assignee: Sharp Kabushiki Kaisha, Osaka, Japan

[21] Appl. No.: 104,845

[22] Filed: Aug. 12, 1993

[30] Foreign Application Priority Data

| | | | |
|---|---|---|---|
| Aug. 25, 1992 | [JP] | Japan | 4-225531 |
| Nov. 27, 1992 | [JP] | Japan | 4-318167 |
| Feb. 24, 1993 | [JP] | Japan | 5-035227 |
| Jun. 2, 1993 | [JP] | Japan | 5-131831 |

[51] Int. Cl.[6] ..... H01J 31/12

[52] U.S. Cl. ..... 313/495; 313/496; 313/309; 313/336; 313/351

[58] Field of Search ..... 313/494, 495, 309, 336, 313/351, 496, 497

[56] References Cited

U.S. PATENT DOCUMENTS

| | | | |
|---|---|---|---|
| 3,789,471 | 2/1974 | Spindt et al. . | |
| 3,855,499 | 12/1974 | Yamada et al. | 313/494 |
| 4,857,161 | 8/1989 | Borel et al. . | |
| 5,157,304 | 10/1992 | Kane et al. | 313/495 |
| 5,256,936 | 10/1993 | Itoh et al. | 313/495 |

FOREIGN PATENT DOCUMENTS

| | | |
|---|---|---|
| 0234989 | 9/1987 | European Pat. Off. . |
| 0387738 | 9/1990 | European Pat. Off. . |
| WO91/10252 | 7/1991 | WIPO . |

*Primary Examiner*—Donald J. Yusko
*Assistant Examiner*—N. D. Patel
*Attorney, Agent, or Firm*—Nixon & Vanderhye

[57] ABSTRACT

An electron tube is constructed to seal in vacuum a substrate for supporting an electron collect electrode, a substrate for supporting a cold cathode array, and a part of an electrode structure. Electrons, emitted from an electron discharge area composed of the cold cathode array and the electrode for picking up an electron beam, pass through a vacuum area and reach an electron collect electrode. The vacuum area is formed by anode jointing the outer peripheral portion of the substrate 1 for supporting the electron collect electrode with the part of the electrode for picking up an electron beam in a vacuum bath. After sealing them in vacuum, the vacuum level of the vacuum area can be kept unchanged when the electron tube is taken out of the vacuum vessel.

20 Claims, 17 Drawing Sheets

ELECTRON EMITTING DEVICE

BACKGROUND OF THE INVENTION

The present invention relates to an electron emitting device for emitting electrons based on a principle of electric field emission, and in particular to an electron emitting device having a vacuum-sealed structure which operates as a vacuum tube, a display or the like.

In recent years, a fine working technique used in the field of forming an integrated circuit or a thin film has remarkably pushed the progress of a technique for manufacturing an electric field emission type electronic element for emitting electrons in a high electric field. In particular, the technique makes it possible to manufacture an electric field emission type cold cathode having a quite small structure. This type of electric field emission type cold cathode is an element of a fundamental electron emission device composing a triode type very small electron tube or electron gun. The electron source of this type of electric field emission type cold cathode has been known in some technical reports such as a report of "C. A. Spindt et. al. Journal of Applied Physics of Stanford Research Institute, vol. 47, No. 12, pp. 5248 to 5268 (December, 1976) and is disclosed in U.S. Pat. No. 3,789,471 assigned to C. A. Spindt, et. al. and U.S. Pat. No. 4,307,507 assigned to H. F. Gray, et. al. A structure for sealing such an electron source as an electron tube in vacuum employs a molding technique for vacuum-sealing each one of electron emitting sources composing a cold cathode array in a self-matching manner, which has been published by Kawamura, et. al. of Shin-Nittetu, Ltd. (New Japan Steel, Ltd.) in the Fourth International Vacuum Microelectronics Conference: IVMC 91, Nagahama. Further, another structure has been proposed for accommodating an overall electrode structure in a vacuum vessel, which is disclosed in Japanese Patent Lying Open Nos. 58-205128 and 8-89488.

An electric field emission type electron tube is a vacuum-sealed electrode structure composed of a cold cathode array consisting of a plurality of electron emission sources each having a micron order, an electrode for picking up an electrode beam, formed on and electrically insulated from the cold cathode array, and an electron collect electrode formed on and electrically insulated from the electrode for picking up an electron beam. The electron tube is very short, small, light and thin electron emitting device which serves to very efficiently operate at a large output.

And, as a structure required for sealing the electrode structure in vacuum, the following are mentioned.

(1) It has to keep a stable and high vacuum. As a first cause, if another kind of atoms are even slightly absorbed on the electron emission surface of the electron emitting source, the work function on the electron emission surface greatly changes, thereby making an electron emitting characteristic unstable. As a second cause, if gas is left in the electron tube, the emitted electron beam serves to ionize part of the left gas. The ions are accelerated by means of voltages applied between the cold cathode array (cathode) and the electrode for picking up an electron beam (gate) and between the cold cathode array (cathode) and the electron collect electrode (anode). The accelerated ions with high energy collide with the electron emitting source and are sputtered. This makes the rest of the cold cathode array shorter and the electron emission unstable.

(2) The vacuum vessel has to be as small as possible in a manner to make such a dimensional characteristic of the electrode structure very short, small, light and thin.

However, the molded structure for isolatedly sealing in vacuum a plurality of electron emitting sources composing the cold cathode array in a self-matching manner makes the dimension of the device very short, small, light and thin. Since each (or some) of the electron sources is sealed in vacuum, on the other hand, the residual gas or the gas emitted from the inner wall of the sealed area is variable in the sealed areas. The variety makes the circumstance different so that the operating characteristic for each vacuum-sealed electron emitting source is made uneven. As another sealed structure, it is possible to use such a type of vacuum-sealed structure as disclosed in Japanese Patent Lying Open Nos. 58-205128 or 3-89438, which has been widely used. However, with this structure, the dimension of the device is defined by the size of the vacuum vessel for accommodating the electrode structure. This eliminates the advantage of very short, small, light and thin electrode structure. After the electrode structure is accommodated in the vacuum-sealing vessel, the lid is fixed on the vessel by means of low-melting point glass or metal serving as a sealing member (adhesive agent). The sealing member is melted by applying heat. The application of the heat results in generating gas, thereby being unable to keep high vacuum sealing. As a remedy for this, a getter member may be provided in the vacuum vessel. This remedy, however, makes the dimension of the vacuum vessel larger.

SUMMARY OF THE INVENTION

It is therefore an object of the invention to provide an electron emitting device which is capable of keeping the electrode structure in high vacuum without using the vacuum vessel.

It is another object of the invention to provide an electron emitting device which is capable of very efficiently operating to feed a large output though it is very compact, that is, very short, small, light and thin.

In carrying out these and other objects, according to the present invention, an electron emitting device is arranged to have a first substrate, a second substrate located as opposed to the first substrate, a cold cathode array composed of a plurality of electron emitting sources for emitting electrons based on a principle of electric field emission, an electrode for picking up an electron beam being electrically insulated from the cold cathode array, and an electron collect electrode being electrically insulated from the cold cathode array and the electrode for picking up an electron beam, at least an outer peripheral portion of the first substrate is jointed to an outer peripheral portion of the second substrate in a manner to keep an electron emission space defined by at least the cold cathode array, the electrode for picking up an electron beam, and the electron collect electrode in vacuum.

In the electron emitting device of the invention, the cold cathode array may be formed on the first substrate, the electrode for picking up an electron beam may be formed around the cold cathode array on the first substrate, and the electron collect electrode may be formed as opposed to the cold cathode array and the electrode for picking up an electron beam on the second substrate.

In the electron emitting device of the present invention, the outer peripheral portion of the first substrate, an outer peripheral portion of an insulating layer for electrically insulating the electrode for picking up an electron beam and the first substrate, an outer peripheral portion of the electrode for picking up an electron beam, and the outer peripheral portion of the second substrate may be jointed to one another. In place, the outer peripheral portion of the first substrate, the outer peripheral portion of the insulating layer for electrically insulating the electrode for picking up an electron beam and the first substrate, and the outer peripheral portion of the second substrate may be jointed to one another. In place, the outer peripheral portion of the first substrate, the outer peripheral portion of the insulating layer for electrically insulating the electrode for picking up an electron beam and the first substrate, the outer peripheral portion of the electrode for picking up an electron beam, a spacer provided for jointing, the outer peripheral portion of the electron collect electrode, and the outer peripheral portion of the second substrate may be jointed to each other. In addition, the spacer may be a thin film composed of an electric insulating material formed on the electrode for picking up an electron beam and the electron collect electrode.

In the joint portion of the electron emitting device of the present invention, preferably, one of the joint surfaces is made of a material containing an alkali metal element and an oxygen element and the other is made of an oxidizable element or a material containing the oxidizable element.

The electron emitting device of the present invention may be arranged so that at least one surface of the first substrate is insulated and the cold cathode array and the electrode for picking up an electron beam area formed on the insulated surface of the first substrate as a plurality of lines.

In the electron emitting device of the present invention, the outer peripheral portion of the first substrate, the insulated spacer provided for jointing, and the outer peripheral portion of the second substrate may be jointed to one another in a manner to keep the electron emitting space defined by at least the cold cathode array, the electrode for picking up an electron beam and the electron collect electrode in vacuum. In this case, at at least one end of each of the plurality lines composing the cold cathode array and the electrode for picking up an electron beam, a wiring portion may be provided on the outer peripheral portion of the first substrate. The wiring portion provided on the cold cathode array and the electrode for picking up an electron beam may be jointed to the spacer and the second substrate together with the outer peripheral portion of the first substrate. In place, at at least one of each of the plurality of lines for the cold cathode array, the electrode for picking up an electron beam, and the electron collect electrode, the wiring portion may be provided on the outer peripheral portion of the first substrate. The wiring portions for the cold cathode array, the electrode for picking up an electron beam, and the electron collect electrode may be jointed to the spacer and the second substrate together with the outer peripheral portion of the first substrate.

Further, in this case, the electron collect electrode may be formed not on the first substrate but on the second substrate.

According to the present invention, in the electron emitting device as arranged above, the dimension of the electrode structure composed of two substrates for supporting the cold cathode array, the electron collect electrode and the like is equal to the dimension of the electron tube. The manufactured device is made very short, small, light and thin. Further, since all the electron emitting sources composing the cold cathode array are accommodated in the same vacuum circumstance, the unstable operation resulting from a variety of the circumstances of the electron emitting sources is improved. Further, when joining the electrode structures in vacuum, at least at the jointing portion when sealing the structures in vacuum, one jointed surface is made of a material containing an alkali metal element and an oxygen element and the other joint surface is made of an oxidizable element or a material containing the oxidizable element. Hence, without using the sealing member, for example, the use of the heat which is so low as not melting the joint portion and the voltage makes it possible to joint them (at anodes). This results in inhibiting generation of gas, thereby keeping highly vacuum sealing. And, as mentioned above, the electron emitting device according to the present invention may be used as a high-performance vacuum or display and may be used as a very rapid integrated circuit which is allowed to feed a large output and highly efficiently and rapidly do switching as compared to a GaAs device matching in size to this device, though it is substantially very short, small, light and thin.

Further objects and advantages of the present invention will be apparent from following the description of the preferred embodiments of the present invention as illustrated in the accompanying drawings.

DESCRIPTION OF THE PREFERRED EMBODIMENTS

Figure 1:
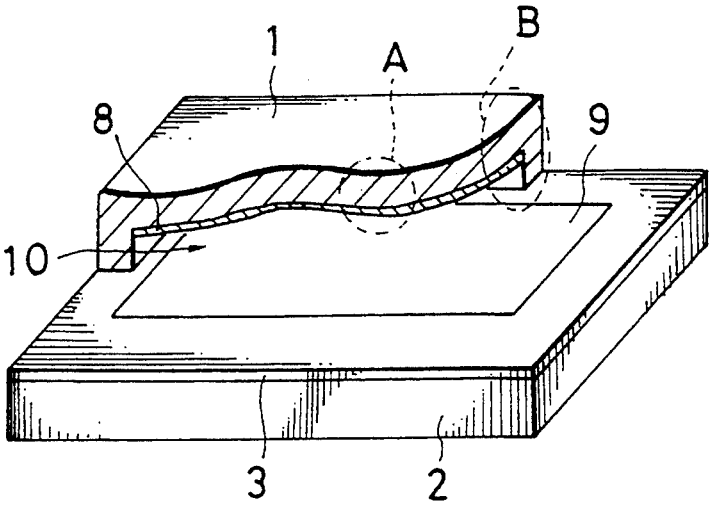
FIG. 1 is a schematic sectional perspective view showing an essential part indicating a triode arrangement of an electron emitting device according to an embodiment of the present invention.

Then, the description will be oriented to embodiments of this invention as referring to the drawings.

Figure 2:
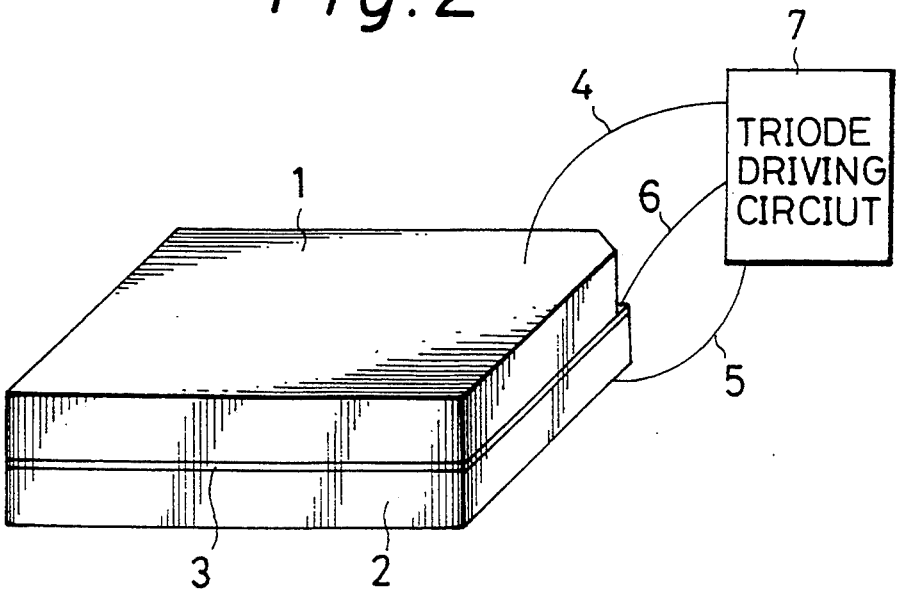
FIG. 2 is a perspective view schematically showing the overall part of the triode as shown in FIG. 1.

FIG. 1 is a schematic sectional perspective view showing an essential part of a triode structure which is an electron emitting device according to an embodiment of the present invention. FIG. 2 is a schematic perspective view showing an overall triode shown in FIG. 1.

As shown in FIG. 2, the triode has a vacuum-sealed structure having a substrate 1 for supporting an electron collect electrode, a substrate 2 for supporting a cold cathode array, and an outer peripheral portion 3 of the electrode structure. That is, the joint portion provided for keeping an internal electron emission space in vacuum has a laminated structure composed of the outer peripheral portion of the cold cathode array supporting substrate 2, the outer peripheral portion of part of the electrode structure, and the outer peripheral portion of the electron collect electrode supporting substrate 1. The detail about this structure will be discussed later.

Further, 4 denotes a lead wire of the electron collect electrode. Item 5 denotes a lead wire of the cold cathode array, 6 denotes a lead wire of the electrode for picking up an electron beam and 7 denotes a triode driving circuit.

As shown in FIG. 1, electrons emitted from an electron emitting area 9 containing the cold cathode array (cathode) and the electrode for picking up an electron beam (gate) pass through a vacuum area 10 served as an electron emitting space and reach the electron collect electrode (anode) 8. The vacuum area 10 is formed by jointing the outer peripheral portion of the electron collect electrode supporting substrate 1 and the outer peripheral portion of the electrode for picking up an electron beam (gate) on the outer periphery of electron emission in a vacuum bath. Then, after the triode is removed out of the vacuum bath, the vacuum area 10 keeps its vacuum level unchanged.

Next, the description will be oriented to the connection of lead wires 4, 5, and 6 with the electrodes as shown in FIG. 2.

At first, the connection of the lead wire 4 of the electron collect electrode will be described. At first, a hole with a diameter of 200 $\mu m\phi$ is formed on a glass plate served as a substrate for supporting the electron collect electrode by means of an electric discharge machining technique and then niobium (Nb) is buried in the hole. The lower portion of the exposed niobium corresponds to the location where the niobium is deposited when manufacturing the electron collect electrode. The lead wire 4 is connected to the upper portion of the exposed niobium by means of the normal bonding technique.

The cold cathode array lead wire 5 is connected to a niobium (Nb) film formed on the opposite surface to the cold cathode array forming surface of the silicon (Si) substrate serving as a substrate for supporting the cold cathode array by means of a bonding device.

When sealing the electrode structure in vacuum, a part of the electrode layer for picking up an electron beam is exposed in the air and the niobium (Nb) film is formed (or pre-formed) on the part of the exposed surface of the electrode layer. The electrode lead wire 6 for picking up an electron beam is connected to the niobium (Nb) film by means of a bonding device.

Figure 3:
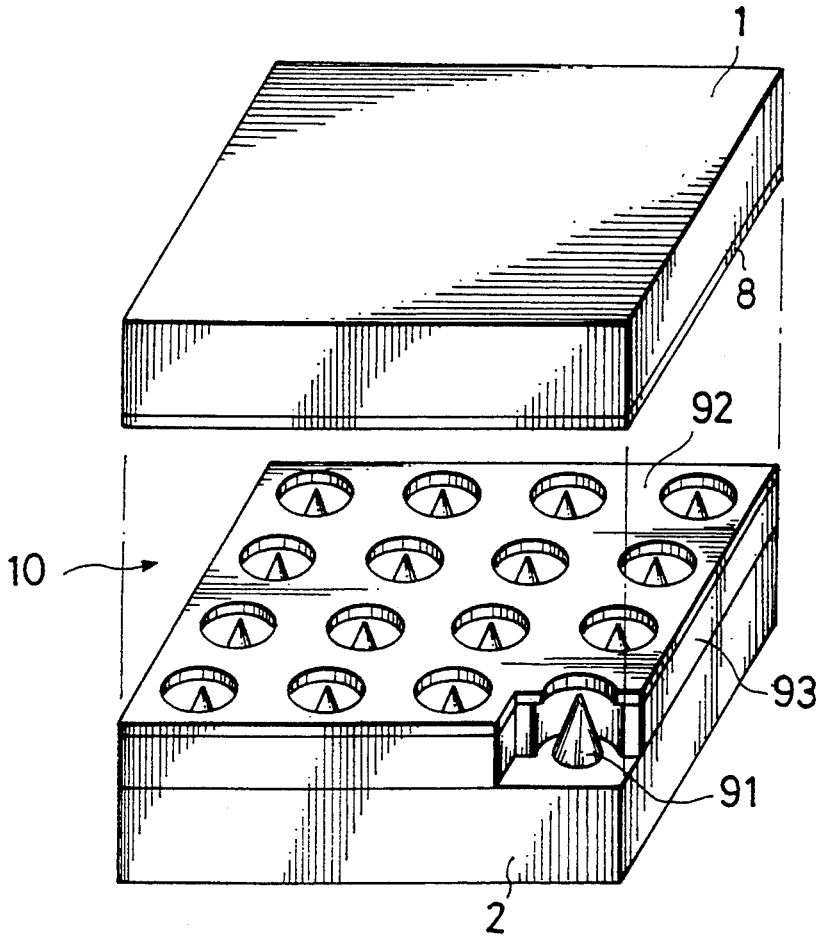
FIG. 3 is an expanded sectional view showing an A section enclosed in a dotted line of FIG. 1.
Figure 4:
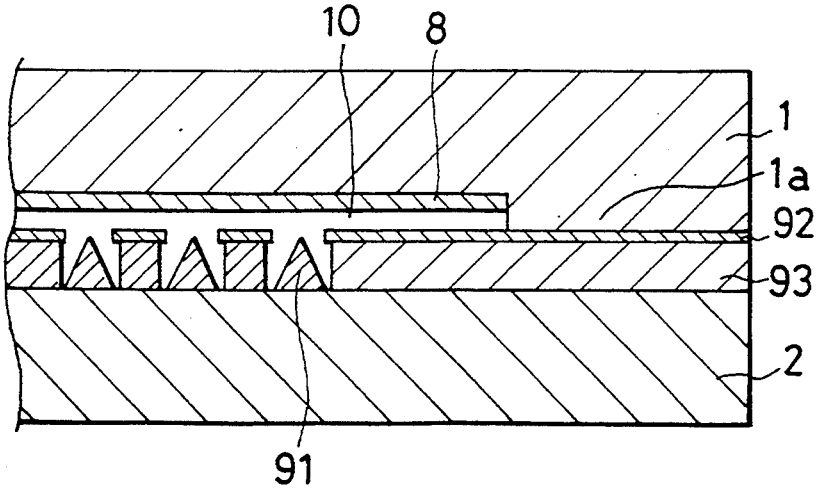
FIG. 4 is an expanded sectional view showing a B section enclosed by a dotted line of FIG. 1.

FIG. 3 is an expanded sectional perspective view showing an A section enclosed by a dotted line of FIG. 1. FIG. 4 is an expanded sectional view showing a B section enclosed by a dotted line of FIG. 1.

Figure 8:
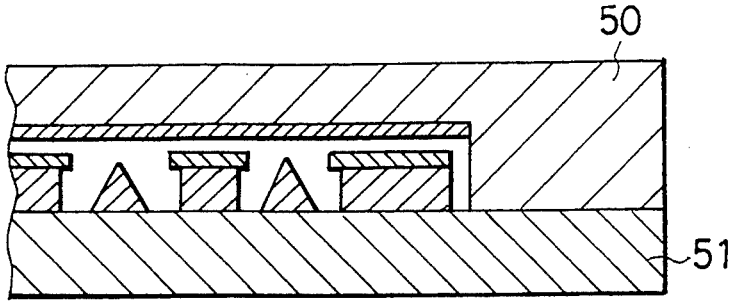
FIG. 8 is a sectional view showing a joint portion included in the electron emitting device according to a second embodiment of the present invention.

As shown in FIG. 8, the electrode structure provides an electron collect electrode 8 formed on the substrate 1 and an electron discharge structure composed of the cold cathode array (cathode) consisting of a plurality of electron discharge sources 91 and an electrode for picking up an electron beam (gate) 92. This electrode structure is manufactured by the manufacture method proposed by C. A. Spindt, et. al.

The electron discharge source 91 for discharging electrons based on the principle of the electric field discharge is conical and is formed on the substrate 2 for supporting a cold cathode array by using metal or a semiconductor material. Around the tip of the electron discharge source 91, an electrode 92 for picking up an electron beam is located. The electrode 92 is laminated on the substrate 2 for supporting the cold cathode array and an electrically insulated layer 93. In this structure, a voltage is applied between the electron discharge source 91 and the electrode 92 for picking up an electron beam so that a high electric field may be generated between them. Based on the principle of the electric field discharge, the electrons are discharged from the tip of the electron discharge source 91. The discharged electrons are accelerated and directed to the electron collect electrode (anode) 8 where a higher voltage than the electrode 92 for picking up an electron beam is applied.

The portion shown as an outer peripheral portion 3 which is a part of the electrode structure shown in FIG. 1 is served as a joint section for keeping a vacuum area 10 in vacuum. The portion 3 includes the similar structure to the laminated structure of the electrode 92 for picking up an electrode and the insulated layer 93 as shown in FIG. 3. This is more obvious from FIG. 4. The joint section is a laminated structure consisting of the substrate 2, the outmost peripheral portion of the laminated layer 93, the outmost peripheral portion of the electrode 92 for picking up an electrode, and a projection 1*a* directed to the electrode 92 of the substrate 1. In this embodiment, therefore, as shown in FIG. 2, the electron collect electrode 8 is screened off the atmosphere. For the purpose, the lead wire 4 is required as described with respect to FIG. 2.

Next, with reference to FIG. 5, the description will be oriented to a method for manufacturing an electron discharge structure consisting of the cold cathode array and the electrode for picking up an electron beam.

Figure 5A:
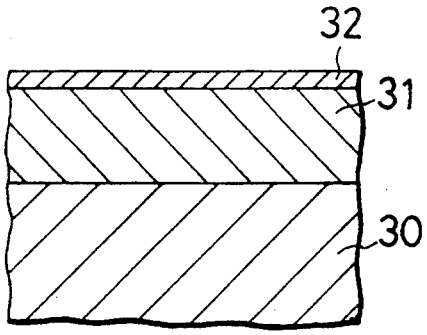
FIGS. 5A to 5E are views for explaining a method for manufacturing an electron emitting structure shown in FIG. 3.
Figure 5D:
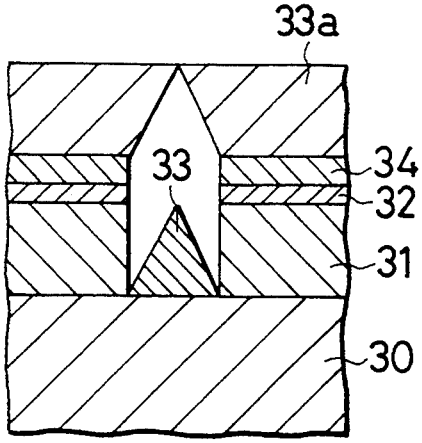
Figure 5B:
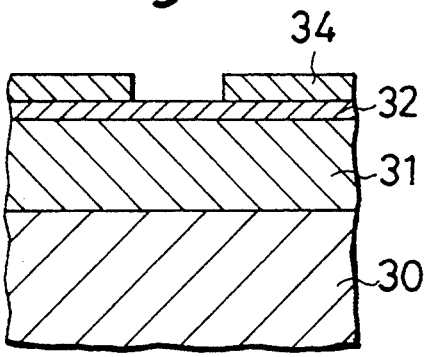
Figure 5E:
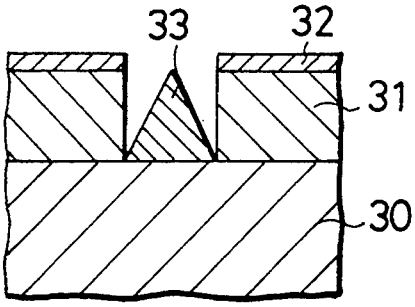
Figure 5C:
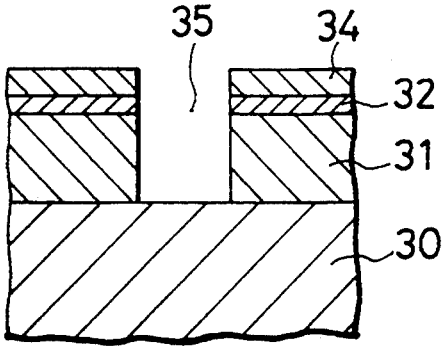

As shown in FIG. 5A, by performing a thermal oxidation treatment on the surface of a silicon (Si) substrate 30 with a thickness of about 0.4 mm, an insulated layer 31 made of silicon dioxide ($SiO_2$) is formed to have a thickness of 1 μm. On the insulated layer 31, a titanium (Ti) layer is formed to have a thickness of about 3000 Å by means of the sputtering device. The titanium layer serves as the electrode 32 for picking up an electron beam. Next, as shown in FIG. 5B, on the electrode layer 32, resist is coated with a spinner and a desired pattern is printed on the resist layer 34 by means of a wafer stepper. Then, the resulting layer is developed for forming a resist pattern in order that the electrode for picking up an electron beam may be exposed only on a predetermined area. Herein, the film thickness of the resist layer is about 1 μm. Then, the electron beam pick-up electrode layer 32 exposed to the surface and the insulated layer 31 located under it are removed by means of a dry etching technique in sequence. As a result, as shown in FIG. 5C, a small aperture 35 with a diameter of about 1 μm is formed. By depositing a material for an electron discharge source vertically to the aperture 35, as shown in FIG. 5D, a conical electron discharge source 33 is formed on the silicon (Si) substrate 30 as the diameter of the aperture is made smaller. Herein, as the material for an electron discharge source, titanium nitride (TIN) is used. When forming a conical electron discharge source 33, the titanium nitride (TiN) 33*a* deposited on the resist layer 34 on the surface of the electrode layer 32 for picking up an electron beam is removed by a lift-off technique, that is, removing the resist layer 34. As a result, the electron discharge structure shown in FIG. 5E is obtained. In this embodiment, a plurality of such electron discharge structures are formed on the same substrate in an array manner for composing the cold cathode array.

The joint portion used when performing the vacuum sealing of the triode according to this embodiment is made of an outer peripheral portion of the electrode for picking up an electron beam and the substrate for supporting the electron collect electrode. Herein, though the material for the electrode for picking up an electron beam uses titanium (ti), the material is not limited to it. The oxidizable material may be silicon (Si), molybdenum (Mo), tungsten (W), niobium (Nb), aluminum (Al), copper (Cu), chromium (Cr), zirconium (Zr) or a material containing one or some of these materials.

Likewise, the material for an electron discharge material is not limited to the titanium nitride.

Next, with reference to FIG. 6, the description will be oriented to the method for manufacturing the structure containing an electron collect electrode.

Figure 6A:
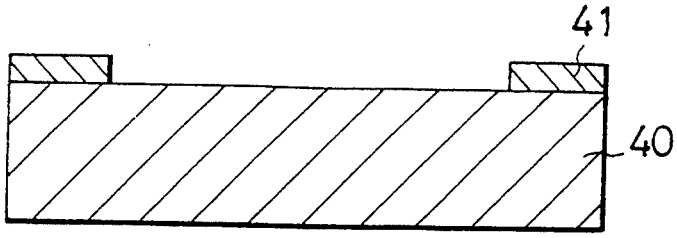
FIGS. 6A to 6D are views for explaining a method for manufacturing a structure containing an electron collect electrode.

As shown in FIG. 6A, resist is coated on the surface of a glass substrate 40 with a thickness of 0.4 mm by means of a spinner. A desired pattern is printed on the resist layer 41 by means of a wafer stepper and then is developed for forming a resist pattern in order that only the predetermined areas of the glass substrate are exposed. The glass substrate 40 is made of Pyrex, for example.

Figure 6B:
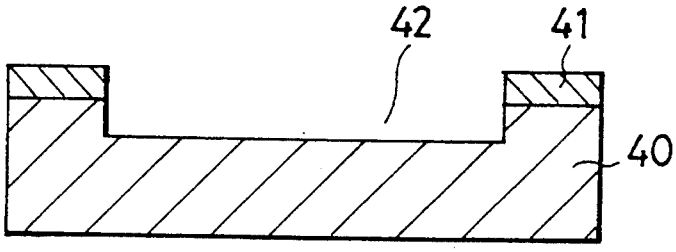
Figure 6C:
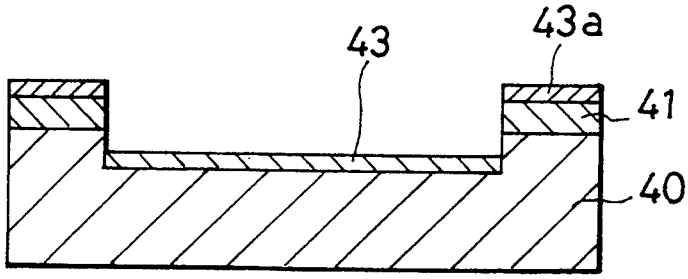
Figure 6D:
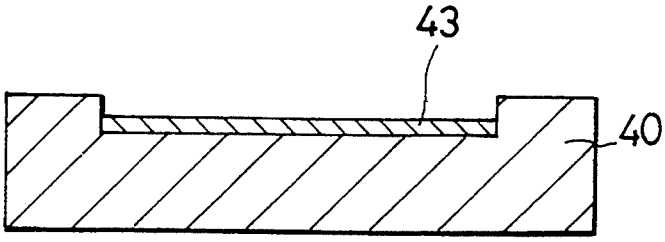

The form of the resist pattern is a fascia or picture frame type enclosing a larger area of the electron emitting area 9 and has a thickness of about 0.8 μm. The glass substrate exposed onto the surface is removed by a wet-etching technique with hydrofluoric acid. Then, as shown in FIG. 6B, a concave portion 42 having a flat bottom and a depth of about 5 μm is formed on the glass substrate 40. Herein, the illustration is simplified. In practice, however, the side of the concave portion 42 is sloped through the effect of etching under the resist 41 (the undercut effect). By depositing the material of the electron collect electrode vertically to the concave portion 42, as shown in FIG. 6C, the electron collect electrode 43 is formed on the bottom of the concave portion 42. As a material for the electron collect electrode, niobium (Nb) is used. The thickness of the electrode is about 2500 Å. When manufacturing the electron collect electrode 43, the niobium (Nb) layer 43*a* deposited on the resist layer 41 may be removed by the lift-off technique, that is, by removing the resist layer 41. The resulting structure is the structure containing the electron collect electrode 43 shown in FIG. 6D.

As mentioned above, the joint portion used when performing the vacuum sealing of the triode according to this embodiment is the outer peripheral portion of the electrode for picking up an electron beam and the outer peripheral portion of the substrate for supporting the electron collect electrode. In the foregoing embodiment, the substrate for supporting the electron collect electrode is made of Pyrex glass. It is not limited to the Pyrex. The material may be a material containing an alkali metal element and an oxygen element such as normal glass, soft glass and ceramics.

Further, the material for the electron collect electrode is not limited to niobium. For example, if the electron tube is used for a display, the material for the electron collect electrode is a transparent conductive film material. The film is formed on the glass substrate and then a fluorescent layer is formed. The structure containing the electron collect electrode and the structure having the cold cathode array and the electrode for picking up an electron beam provides the vacuum area 10 formed by jointing the outer peripheral portion of the electrode 92 for picking up an electron beam and an outer peripheral portion of the substrate 1 for supporting the electron collect electrode or by means of the method described below.

Figure 7:
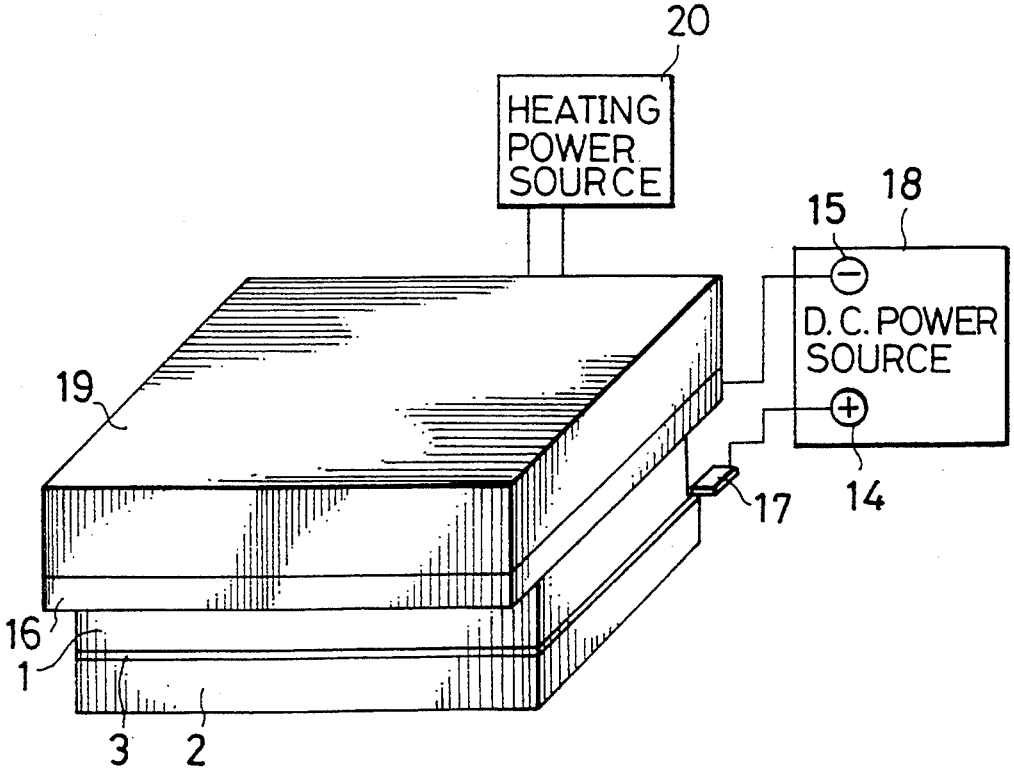
FIG. 7 is a view for explaining a method for sealing an electrode structure in vacuum, that is, a method for jointing an outer peripheral portion of an electrode for picking up an electron beam and an outer peripheral portion of an substrate for supporting an electron collect electrode in this embodiment.

Next, the description will be oriented to a method for sealing the electrode structure in vacuum, that is, in this embodiment, a method for jointing the outer peripheral portion of the electrode for picking up an electron beam and the outer peripheral portion of the substrate for supporting the electron collect electrode by referring to FIG. 7.

In the vacuum chamber in which the vacuum level reaches $10^{-8}$ Torr, the electron collect electrode surface is located at the upper portion matching to the overall surface of the electron discharge area 9. That is, the fascia type joint portion of the outer peripheral portion of the substrate 1 for supporting the electron collect electrode is located in close contact with the surface of the electrode 92 for picking up an electron beam outer than the electron emitting area 9. Next, a negative electrode plate 16 is pressurized on the substrate 1 for supporting an electron collect electrode and a positive electrode plate 17 is pressurized on the surface of the electrode 92 for picking up an electron beam. The negative electrode plate 16 is connected to a negative electrode 15 of a d.c. power source 18 and the positive electrode plate 17 is connected to a positive electrode 14 of the d.c. power source 18 so that a voltage may be applied between the electrode 92 for picking up an electron beam and the substrate 1 for supporting an electron collect electrode. When applying a voltage, a resistor heating unit 19 serves to protect the electron beam pick-up electrode 92 and the electron collect electrode supporting substrate 1 from being heated. Item 20 denotes a power source for heating. In this embodiment, the heating temperature is 350° C. and the applied voltage is 650 V for five minutes. This treatment results in forming titanium oxide serving as a joint layer on the contact interface between the electrode 92 for picking up an electron beam and the substrate 1 for supporting the electron collect electrode and thereby implementing complete joint. After jointing, if this triode is taken from the vacuum chamber to the atmosphere, the vacuum level is kept in the vacuum-sealed area. In addition, the heating temperature, the applied voltage and the duration are not limited to the above. They may be suitably variable depending on the material or the form of the jointed member.

Further, this structure makes it possible to laminate two or more electron tubes being connected with each other. This results in being able to manufacture a higher density electron device. When jointing, a high d.c. voltage may be applied in a manner that the substrate 1 (glass) for supporting the electron collect electrode of one electron tube is negative and the substrate 2 (silicon) for supporting the cold cathode array of the other electron tube is positive.

In the foregoing embodiment, the vacuum area may be formed by jointing the outer peripheral portion of the electrode for picking up an electron beam with the other peripheral portion of the substrate for supporting an electron collect electrode. In place, by changing the joint portion of the lead wire of the electrode for picking up an electron beam, it is possible to form the vacuum area only from the substrate for supporting the cold cathode array and the substrate for supporting the electron collect electrode. FIG. 8 is a section view showing the joint section formed in this embodiment. In this embodiment, a projected portion provided on the outer peripheral portion of the substrate 50 for supporting the electron collect electrode made of Pyrex glass, for example and the outer peripheral portion of the substrate 51 for supporting the cold cathode array are jointed by the above-mentioned method, for forming the joint portion.

Figure 9:
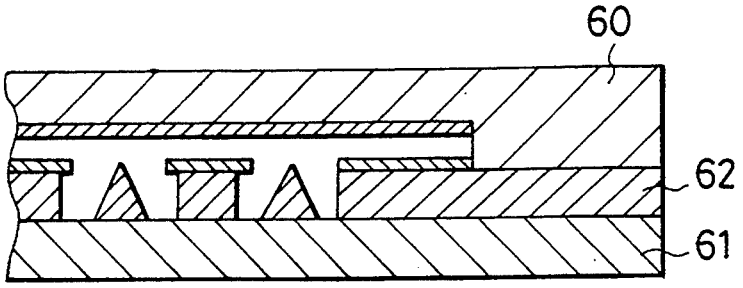
FIG. 9 is a sectional view showing a joint portion included in the electron emitting device according to a third embodiment of the present invention.

Further, FIG. 9 is a sectional view showing a joint portion implemented according to the third embodiment of the invention. In this embodiment, the joint portion includes a structure in which there are laminated a projected portion formed on the outer peripheral portion of the substrate 60 for supporting the electron collect electrode, the substrate 60 being made of Pyrex glass, for example, the insulated layer 62, and the outer peripheral portion of the substrate 61 for supporting the cold cathode array. In this case, for example, the projected portion formed on the outer peripheral portion of the substrate 60 for supporting the electron collect electrode and the insulated layer 62 are jointed by means of the above-mentioned method.

Figure 10:
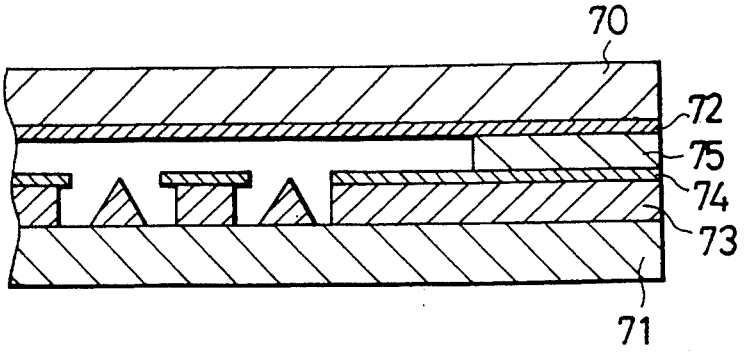
FIG. 10 is a sectional view showing a joint portion included in the electron emitting device according to a fourth embodiment of the present invention.

Next, FIG. 10 is a section view showing the joint portion formed according to the fourth embodiment of the invention. In this embodiment, the joint portion includes a structure in which there are laminated an outer peripheral portion of the substrate 70 for supporting the electron collect electrode, the outer peripheral portion of an electron collect electrode 72, a spacer 75 made of Pyrex glass, for example, the outer peripheral portion of a substrate 71 for supporting the cold cathode array, an insulated layer 73, and the outer peripheral portion of a substrate 71 for supporting the cold cathode array. In this case, for example, both sides of the spacer 75, the outer peripheral portion of the electron collect electrode 72 and the outer peripheral portion of the electrode 74 for picking up an electron beam are jointed by means of the above-mentioned method. In this embodiment, the lead wire for the electron collect electrode as shown in FIG. 2 may be directly connected to the niobium film formed on part of the electron collect electrode 72.

In this fourth embodiment, the spacer 75 may be made of Pyrex glass. In its place, it is possible to use a thin film made of an electrically insulating material such as silicon dioxide and silicon nitride with addition of an alkali metal element. In this case, the electrically insulated film may be formed on the outer peripheral portion of the electrode 74 for picking up an electron beam or the electron collect electrode. This electrically insulated thin film may be jointed with the outer peripheral portion of one having no electrically insulated thin film of the electrode 74 for picking up an electron beam or the electron collect electrode 72 by means of the above-mentioned method, for implementing the vacuum sealing.

In the foregoing embodiment, the substrate for supporting the cold cathode array may be a silicon (Si) substrate. It is possible to form an electrode layer of metal or a semiconductor material on the electrically insulated substrate such as formation of the titanium (Ti) layer on the quartz substrate.

Figure 11:
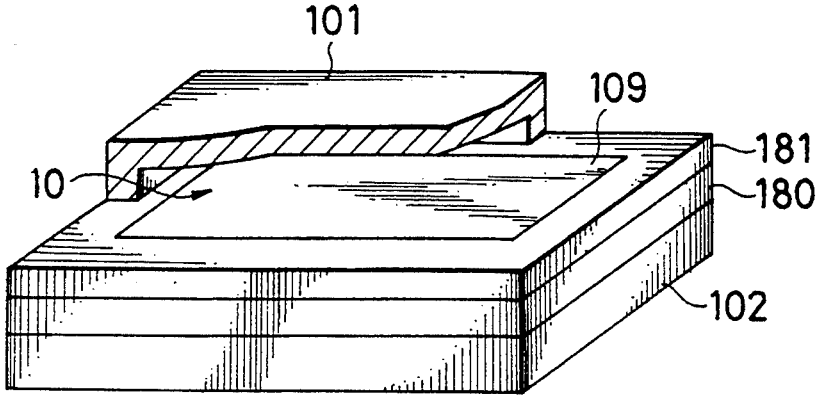
FIG. 11 is a schematic sectional perspective view showing an essential part of the triode arrangement included in the electron emitting device according to a fifth embodiment of the present invention.
Figure 12:
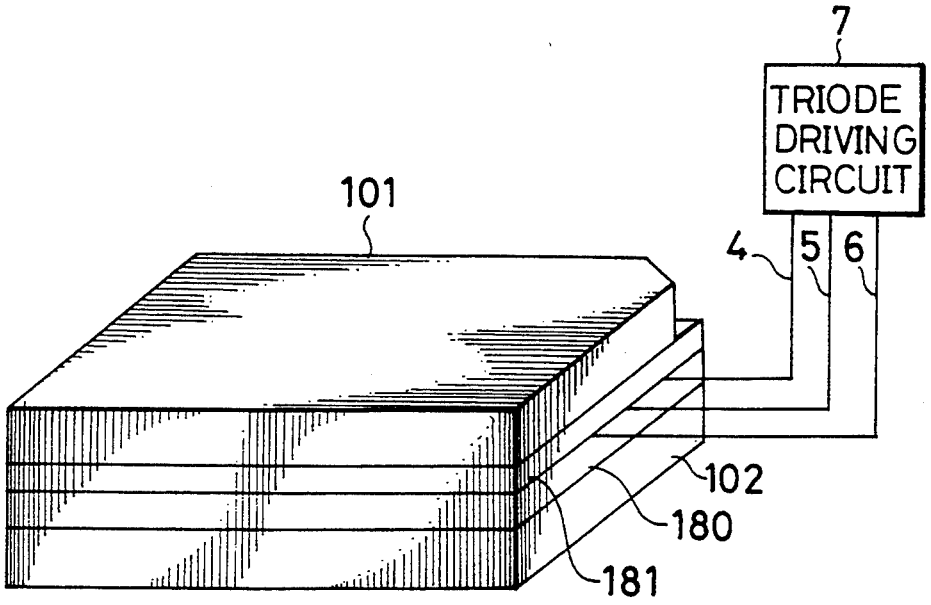
FIG. 12 is a perspective view schematically showing the overall arrangement of the triode as shown in FIG. 11.

The description will be oriented to the fifth embodiment. FIG. 11 is a schematic sectional perspective view showing an essential portion of a triode arrangement according to the fifth embodiment which is an electron emitting device of this invention. FIG. 12 is a perspective view schematically showing the overall arrangement of the triode shown in FIG. 11.

The different aspect of the fifth embodiment from the first to the fourth embodiments is that the triode according to this embodiment is a vacuum-sealed structure arranged to seal in vacuum an outer peripheral portion of a substrate 102 for supporting an electrode structure including at least a cold cathode array (cathode), an electrode for picking up an electron beam (gate), and an electron collect electrode (anode), an outer peripheral portion of an electrically insulated layer 180 provided on the substrate 102 for supporting the electrode structure, a spacer 181, and an outer peripheral portion of a joint substrate 101.

The lead wire 4 for the electron collect electrode, the lead wire 5 for the cold cathode array, and the lead wire 6 for the electrode for picking up an electron beam are connected to exposed wiring portions (not shown) of the electron collect electrode, the cold cathode electrode and the electrode for picking up the electron beam, respectively, by means of a bonding device.

And, in FIG. 11, an electron emitting area 109 includes an electron collect electrode in addition to the cold cathode array and the electrode for picking up an electron beam unlike the first to the fourth embodiments. In addition, the vacuum area 10 is formed by jointing the outer peripheral portion of a substrate 102, the outer peripheral portion of the electrically insulated layer, the spacer 181, and the outer peripheral portion of the joint substrate 101. Then, if the triode is removed out of the vacuum bath, the vacuum level is maintained the vacuum area 10.

Figure 13:
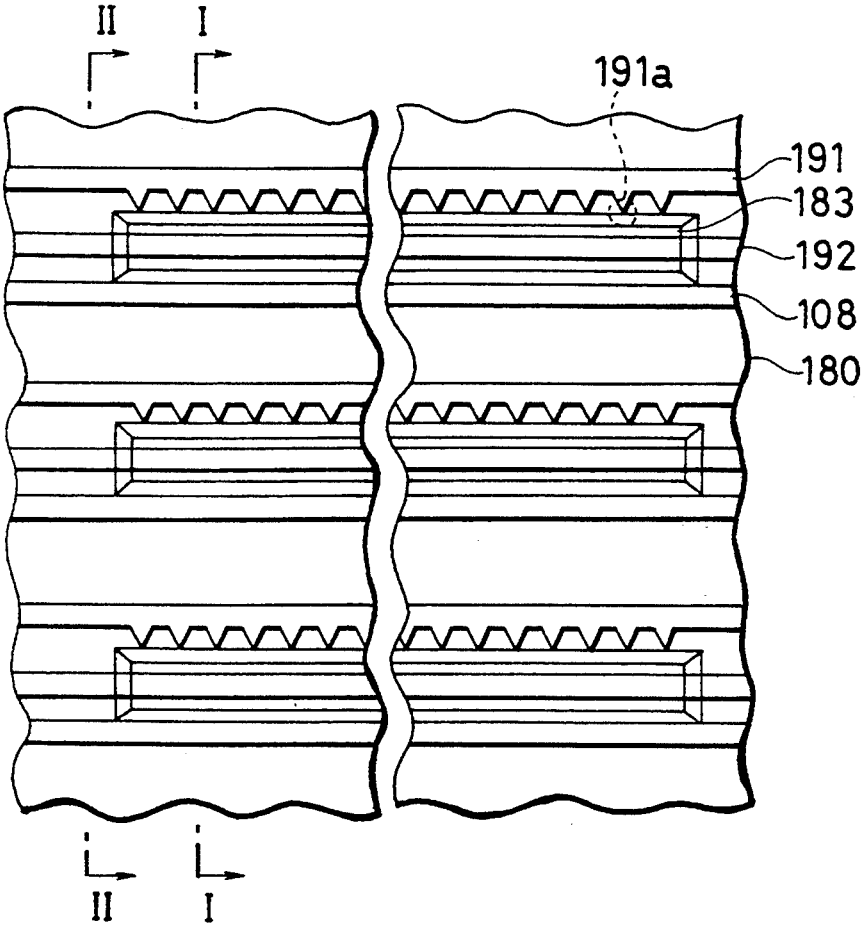
FIG. 13 is an expanded top view showing an electrode structure of the triode as shown in FIG. 11.

With reference to FIGS. 13, 14, 15 and 16, the construction of the electrode structure formed on the substrate 102 for supporting the electrode structure shown in FIG. 11 will be discussed. FIG. 13 is an expanded top view showing an essential part of the electrode structure. As shown in FIG. 13, on an electrically insulated layer formed on the substrate for supporting the electrode structure, there are formed a cold cathode electrode 191 composing a cold cathode array consisting of a plurality of electron emitting portions for emitting electrons based on the principle of electric field discharge, an electrode 192 for picking up an electron beam, being electrically insulated from the cold cathode electrode 191, and an electron collect electrode 108 electrically insulated from the cold cathode electrode 192 and the electrode 191 for picking up an electron beam. These electrodes are respectively formed in two or more lines. In the cold cathode electrode 191, under the electrode 192 for picking up an electron beam of an area where the electron emitted portion 191*a* exists, a groove 183 is formed.

Figure 14:
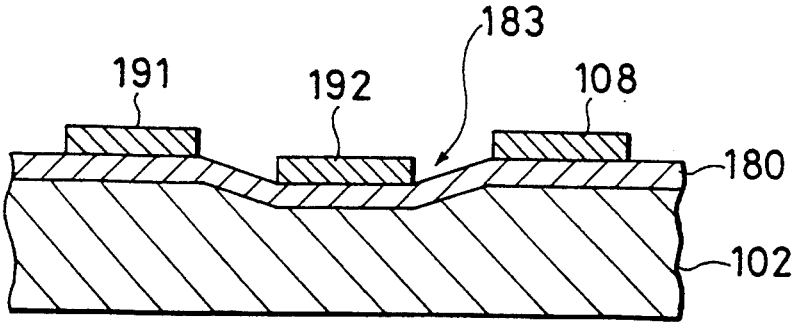
FIG. 14 is an expanded sectional view cut on the line I—I of FIG. 13.
Figure 15:
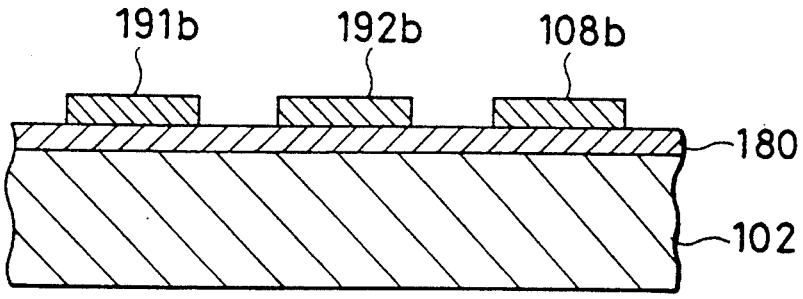
FIG. 15 is an expanded sectional view cut on the line II—II of FIG. 13.

FIGS. 14 and 15 are expanded sections cut on the line I—I and II—II of FIG. 13, respectively. As shown in FIG. 14, in the area where the electron emitting portion exists in the cold cathode electrode, the groove 183 is formed. Along the bottom of the groove 183, the electrode 192 for picking up an electron beam is formed. On the other hand, as shown in FIG. 15, in the area where no electron emitting portion exists in the cold cathode electrode, a groove is not formed. In the portion corresponding to the peripheral portion of the substrate for supporting the electrode structure, a wiring portion 191*b*, a wiring portion 192*b* and a wiring portion 108*b* are formed which respectively correspond to the cold cathode electrode, the electrode for picking up an electron beam, and the electron collect electrode.

Figure 16:
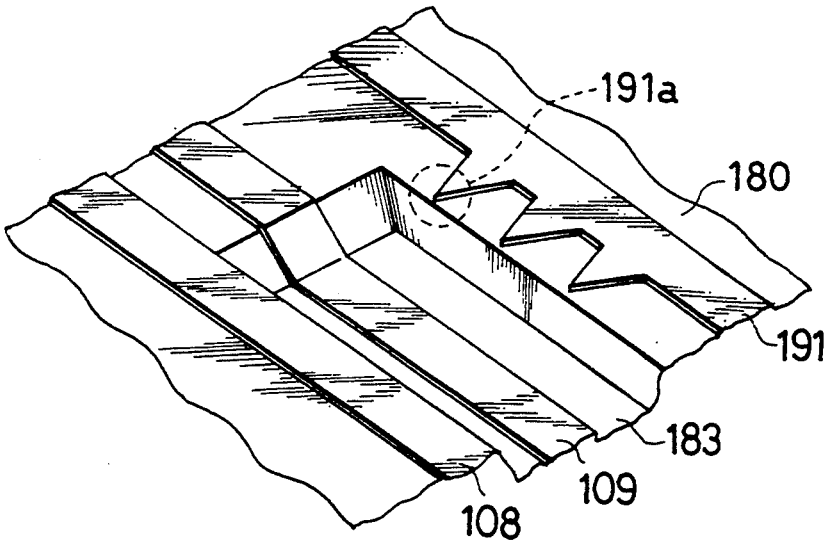
FIG. 16 is an expanded perspective view showing an electrode structure shown in FIGS. 13 to 15.

FIG. 16 is an expanded perspective view showing an essential part of the electrode structure. When a voltage is applied between the cold cathode electrode 191 and the electrode 192 for picking up an electron beam, a high electric field is generated between these electrodes. Based on the principle of electric field discharge, electrons are discharged from an electron discharge portion 191*a* located at the tip of the cold cathode electrode 191. The emitted electrons are accelerated and guided to the electron collect electrode 108 to which a higher voltage than the electrode 192 for picking up an electron beam is applied.

In FIG. 13, each wiring portion is required to be formed at one end of the peripheral portion of the substrate for supporting the electrode structure of the cold cathode electrode 191, the electrode 192 for picking up an electron beam, and the electron collect electrode 108 are continuously formed on the center. If those electrodes are separated and electrically insulated from one another, each wiring portion is required to be formed on both ends of the peripheral portion of the substrate for supporting the electrode structure.

Next, with reference to FIGS. 17 to 21, the method for creating a triode according to this embodiment will be described later. As shown in the top view of FIG. 17, resist is coated on the surface of the silicon (Si) substrate 130 with a thickness of 0.4 mm by means of a spinner. A desired pattern is printed on the resist layer by means of a wafer stepper and then is developed. Then, a resist pattern 184 is formed so that the surface of the silicon (Si) substrate 130 may be exposed only on the area where the groove is to be formed. Herein, the thickness of the resist layer is about 1 μm and the area where the groove is to be formed is a square of about 4 μm x about 200 μm.

Figure 17:
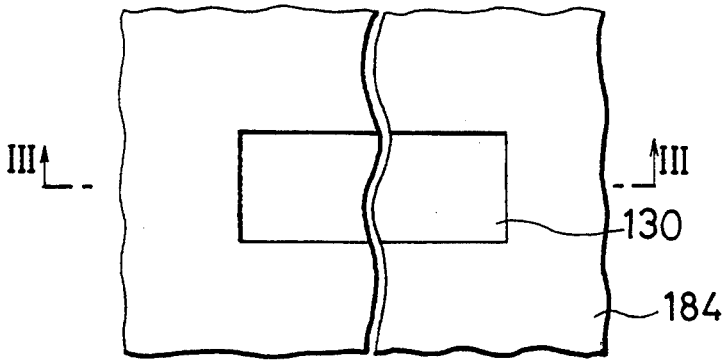
FIG. 17 is a top view for explaining a method for manufacturing the electrode structure shown in FIGS. 13 to 16.
Figure 18A:
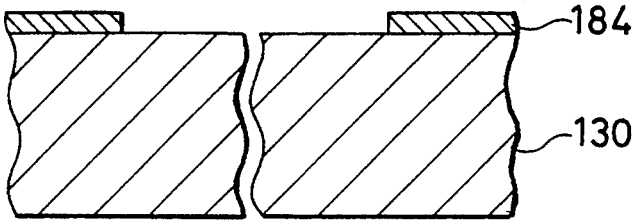
FIGS. 18A to 18C are sectional views cut on the line III—III of FIG. 17 for explaining a method for manufacturing the electrode structure shown in FIG. 17.
Figure 18B:
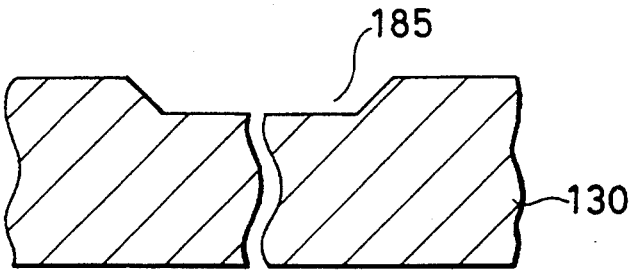
Figure 18C:
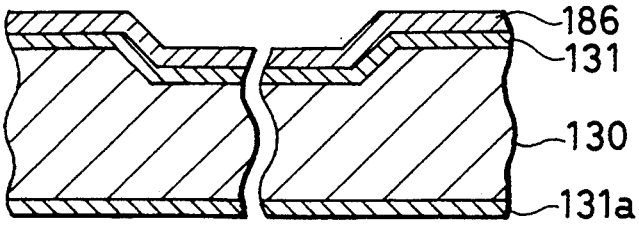
Figure 19:
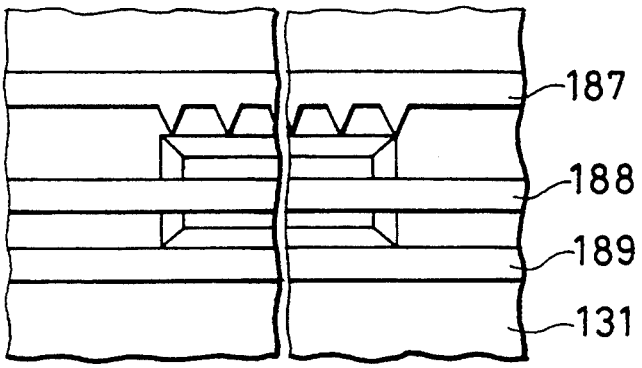
FIG. 19 is a top view for explaining a method for manufacturing the electrode structure shown in FIGS. 13 to 16.

The section on the line III—III of FIG. 17 is as shown in FIG. 18A. Then, the surface on which the silicon (Si) substrate 130 is exposed is removed by the dry etching technique with sulfur hexafluoride ($SF_6$) gas so as to have a hole of a depth of about 0.7 μm. When the resist pattern 184 is removed, a concave portion 185 as shown in FIG. 18B is formed. Next, the silicon (Si) substrate 130 having concave portions molded on the surface is heated and oxidized in dry oxygen at the temperature of 1000° C. and for about 14 hours so that the silicon thermal oxidized layer ($SiO_2$ layer) may be formed to have a thickness of about 3000 Å about its tabular portion. At this time, on the back surface of the silicon substrate 130, there is formed a silicon thermal oxidized layer ($SiO_2$ layer) 131*a*. The impurity formed of oxygen for heating and oxidizing is removed by the cold trap technique. Then, by using the sputtering device or the depositing device, a titanium (Ti) layer 186 as an electrode material is deposited vertically to the surface having concaves thermally oxidized on the silicon (Si) substrate 130. As shown in FIG. 18C, the titanium layer 186 is formed on the substrate to have a thickness of about 3000 Å.

Next, on the titanium (Ti) layer 186, resist is coated with the spinner. Then, a desired electrode structure pattern is printed on the resist layer by means of a wafer stepper and then is developed for forming resist patterns in a manner to expose the titanium (Ti) layer onto only the predetermined area. Then, the titanium (Ti) layer exposed onto the surface is removed down to the thermally oxidized layer ($SiO_2$ layer) by means of the dry etching method. Further, to remove the resist layer, as shown in the top view of FIG. 19, the electrode structure composed of a cold cathode electrode 187, an electrode gate 188 for picking up an electron beam, and an electron collect electrode 189 is manufactured. The form of the cold cathode electrode is a sawtooth type having an electron emitting portion located at the vertex of each triangle. The form is not limited to this.

In this embodiment, as the substrate for supporting the electrode structure, the silicon (Si) substrate is used. It is not limited to the silicon. An electrically insulated substrate such as quartz may be used only if the surface on which the electrode is formed is electrically insulated. In the case of using the electrically insulated substrate, it is not necessary to form an electrically insulated layer such as a silicon thermal oxidized layer ($SiO_2$ layer) formed in this embodiment. Moreover, as the material for the electrode structure, titanium (Ti) is used. This is not limited to it. The material may be silicon (Si), molybdenum (Mo), tungsten (W), niobium (Nb), aluminum (Al), copper (Cu), chromium (Or), zirconium (Zr), carbide or nitride of these metals, an alloy or a laminated film of these metals.

Next, the description will be oriented to formation of the spacer. At first, a resist pattern is formed by the aforementioned patterning method in a manner to allow only the outer peripheral portion of the electrode structure manufactured as above to be exposed. And, on the exposed surface, there is formed a glass layer served as an electrically insulated layer containing an alkali metal element and an oxygen element by the R. F. sputtering device using Pyrex glass as a sputtering target and a mixed gas of oxygen and argon as a sputtering gas. Herein, the thickness of the glass layer is preferably 0.2 μm to 14 μm. Further, if the thickness is 2.0 μm, the excellent result can be obtained where the surface coarseness is 200 Å or lower. Then, the resist layer with the resist pattern is removed by means of the lift-off method and the surface from which the resist layer is removed is exposed and cleaned. With this process, as shown in FIG. 20, a spacer 190 made of a glass layer is formed on the outer peripheral portion of the electrode structure.

Figure 20:
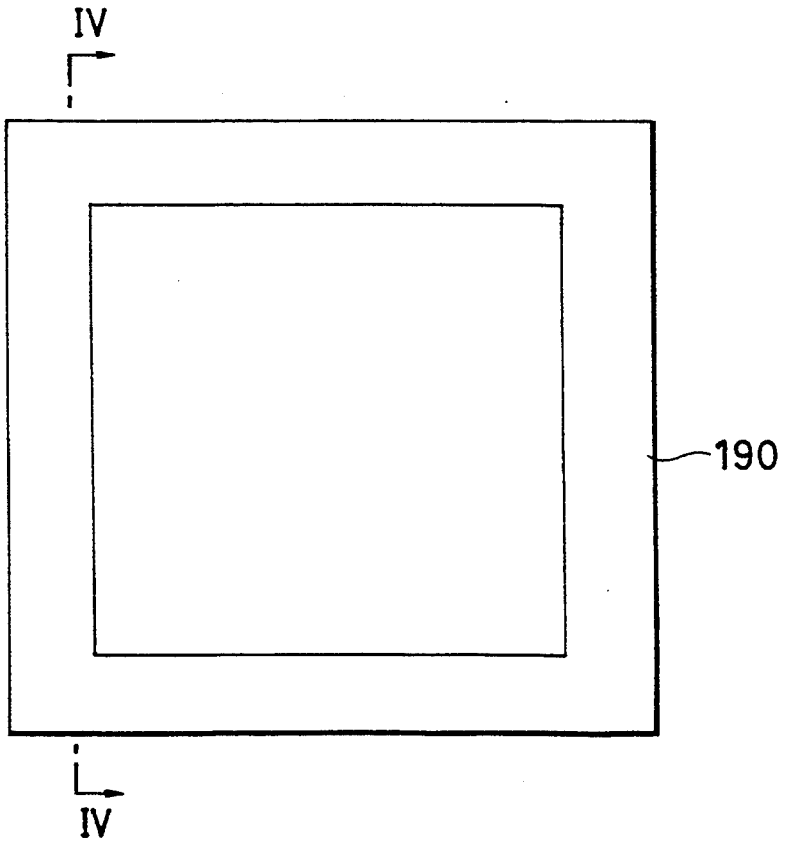
FIG. 20 is a top view for explaining a method for manufacturing a spacer included in the fifth embodiment.
Figure 21:
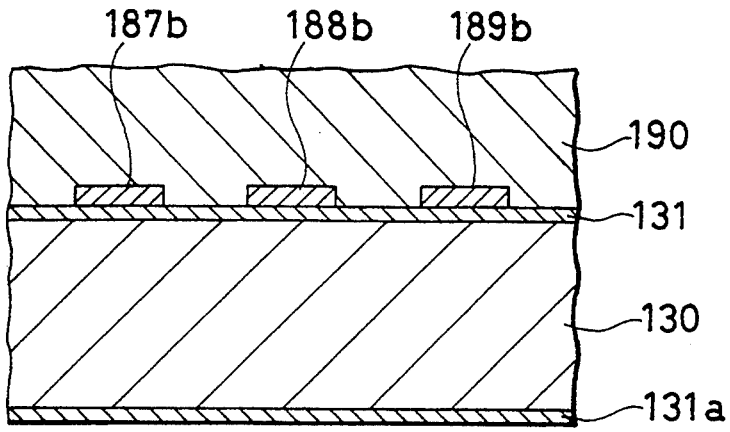
FIG. 21 is a sectional view cut on the line IV—IV of FIG. 20.

The section on the line IV—IV of FIG. 20 is as shown in FIG. 21. A wiring portion **187*b* of the cold cathode electrode formed on a silicon thermal oxidized layer ($SiO_2$ layer) on the silicon (Si) substrate 130, a wiring portion 188*b* for the electrode for picking up an electron beam, and a wiring portion 189*b* for the electron collect electrode are arranged to be located under the silicon thermal oxidized layer ($SiO_2$ layer) 131 and the spacer 190**. In addition, as the wiring portion, it is possible to form a low resistance layer by doping impurity such as antimony, phosphorus, boron in a linear manner. Those layers may be electrically connected to the electrode structure as the wiring portion.

In this embodiment, as the material containing an alkali metal element and an oxygen element for the spacer, Pyrex glass may be used. In actual, the material is not limited to it. It is possible to use normal glass, soft glass or ceramics. In this embodiment, the used etching technique is dry etching. In actual, the technique is not limited to it. As the etching technique, the chemical anisotropic wet etching may be used. Further, the film formation of the electrode and the space is not limited to the method described in the foregoing embodiment.

Figure 22A:
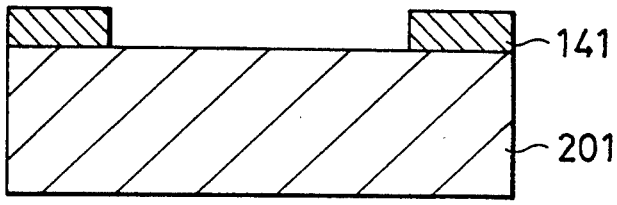
FIGS. 22A to 22C are views for explaining a method for manufacturing a joint substrate included in the fifth embodiment.
Figure 22B:
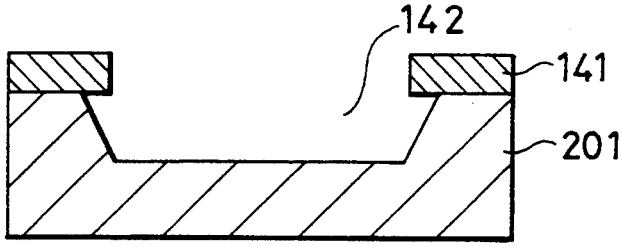
Figure 22C:
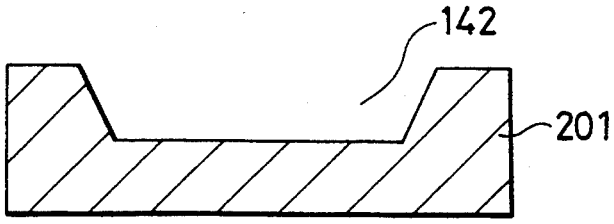

Next, with reference to FIG. 22, the description will be oriented to the method for manufacturing the joint substrate. FIG. 22 is a sectional view showing the method for manufacturing the joint substrate. As shown in FIG. 22A, resist is coated on the surface of a silicon substrate 201 with a thickness of 0.4 mm by means of a spinner. A desired pattern is printed on the resist layer by means of the wafer stepper and is developed for forming a resist pattern 141 so that only some areas of the silicon substrate may be exposed out. The form of the resist pattern is a fascia type enclosing a larger area than the electron emitting area. The thickness is about 0.8 μm. Then, the part of the silicon substrate exposed onto the surface is removed by means of the RIE (Reactive Ion Etching) device. The dry etching with a sulfur hexafluoride ($SF_6$) gas is used for removal. As a result, as shown in FIG. 22B, a concave portion 142 having a flat bottom and a depth of about 5 μm is formed on the silicon substrate 201. Within the RIE device, the resist pattern is removed by means of the *oxygen plasma ashing technique. The resulting structure is as shown in FIG. 22. With this manufacturing method, the joint substrate is manufactured in a manner that the concave portion 142 of this joint substrate may be opposed to the electrode substrate provided on the substrate for supporting the electrode structure. The jointing may be described later.

In this embodiment, the joint substrate is made of silicon. The material is not limited to silicon. It is possible to use an insulated material, a semiconductor, or a metal having at least an oxidizable element or a material containing the oxidizable element on the joint portion for sealing.

Figure 23:
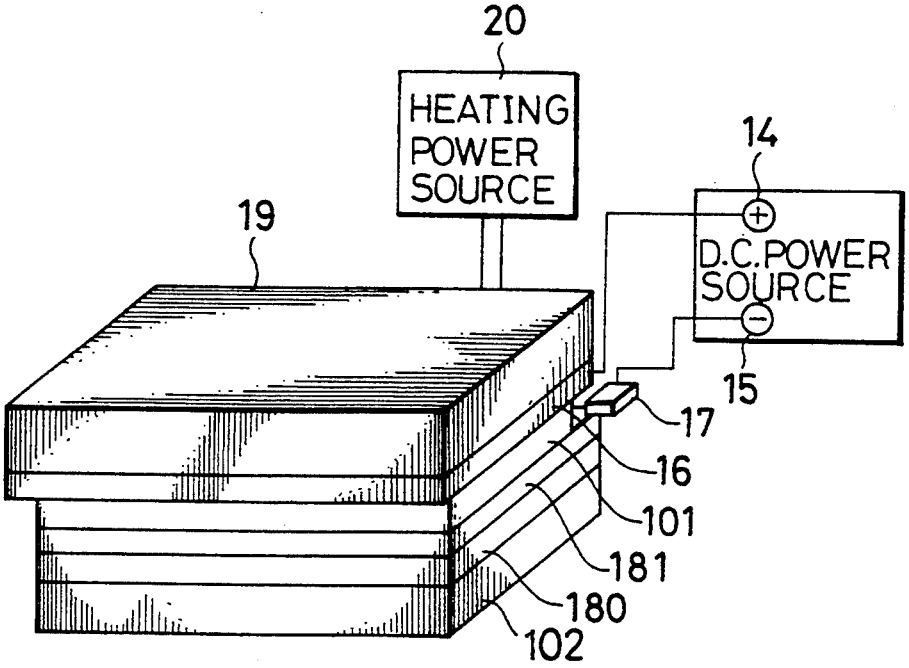
FIG. 23 is a view for explaining a method for sealing (a method for jointing) the electrode structure included in the fifth embodiment in vacuum.

Next, the description will be oriented to a method for sealing the electrode structure in vacuum, that is, a method for jointing the spacer provided on the outer peripheral portion of the electrode structure with the outer peripheral portion of the joint substrate with reference to FIG. 23.

In a vacuum chamber where the vacuum level reaches $10^{-8}$ Torr, the concave portion of the joint substrate 101 is located at an upper portion in a manner to be opposed to the electrode structure. That is, a spacer 181 provided on the outer peripheral portion of the electrode structure and the joint portion, that is, the outer peripheral portion of the joint substrate 101 are located in a manner that the spacer 181 and the joint portion may come into close contact with each other. Next, the negative electrode plate 17 is pressurized on the spacer 181 and the positive electrode plate 16 is pressurized on the joint substrate 101 so that they may be connected to the negative electrode 15 and the positive electrode 14 of the d.c. power source 18. A voltage is applied between the spacer 181 and the joint substrate 101. When applying a voltage, the spacer 181 and the joint substrate 101 are heated by the resistance heating unit 19. Item 20 denotes a heating power source. In this embodiment, the heating temperature is 450° C., the applied voltage is 500 V and the duration is for two minutes. With this application, the silicon oxide is formed as a joint layer on the interface between the spacer 181 and the joint substrate 101 for completing the joint. After jointing, after the triode is removed from the vacuum chamber to the air, the vacuum level in the vacuum-sealed area is maintained. In addition, the heating temperature, the applied voltage, the duration are not limited to the above values but may be properly varied according to the material used and form of the joint member.

In the vacuum-sealing method, the atmosphere of the vacuum chamber when sealing the electrode structure in vacuum is decompressed down to $10^{-8}$ to $10^{-10}$ Torr of the vacuum level. Then, a minute amount of gas such as hydrogen gas, argon gas, nitrogen gas, or carbon monoxide gas is added into the vacuum chamber. The vacuum level is increased to $10^{-5}$ to $10^{-8}$Torr and then the vacuum sealing is performed.

As a sixth embodiment, the description will be oriented to an electron emitting device according to the invention if the electron collect electrode is not formed on the substrate for supporting the electrode structure in the fifth embodiment. On the substrate for supporting the electrode structure of this embodiment, unlike the fifth embodiment, no electron collect electrode is formed but the cold cathode array and the electrode for picking up an electron beam are formed. Like the fifth embodiment, the spacer is provided on the outer peripheral portion of the electrode structure. Herein, in the fifth embodiment, under the electrode for picking up an electron beam, a groove is formed. However, in this embodiment, it is not necessary to form such a groove.

With reference to FIG. 24, the method for manufacturing the joint substrate according to this embodiment will be described below. The silicon (Si) substrate 301 with a thickness of 0.4 mm is thermally oxidized in dry oxygen at a temperature of 1000° C. and for about 14 hours for forming the silicon thermal oxidized layer ($SiO_2$ layer). The silicon layer has a thickness of about 3000 Å on its flat portion. Next, resist is coated on the silicon layer by means of a spinner. On the resist layer, a desired pattern is printed by means of the wafer stepper and is developed for forming a resist pattern so that only predetermined areas of the silicon thermal oxidized layer ($SiO_2$ layer) may be exposed out. Herein, the form of the resist pattern is a fascia type enclosing a larger area than the electron emitting area provided on the substrate for supporting an electrode structure. The film thickness is about 0.8 μm. Then, the silicon thermal oxidized layer ($SiO_2$ layer) exposed out to the surface is removed by means of the wet etching technique with hydrofluoric acid and then the resist pattern layer is removed. As shown in FIG. 24A, on the silicon (Si) substrate 301, there is formed a silicon thermal oxidized layer ($SiO_2$ layer) pattern 241 having a resist pattern transferred thereon.

Figure 24A:
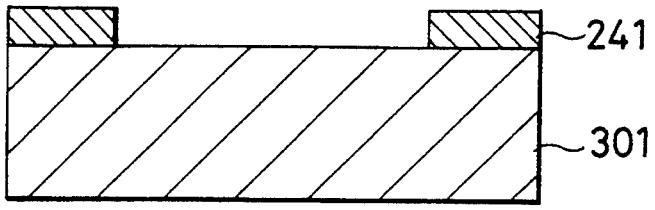
FIGS. 24A to 24D are sectional views for explaining a method for manufacturing a joint substrate included in an electron emitting device according to a sixth embodiment of the present invention.
Figure 24B:
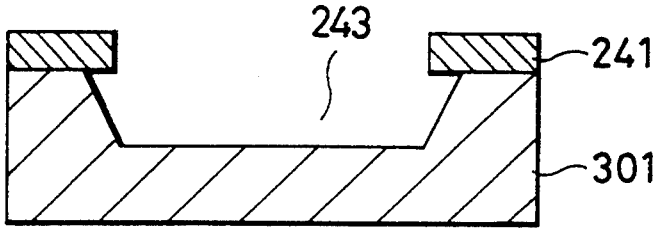
Figure 24C:
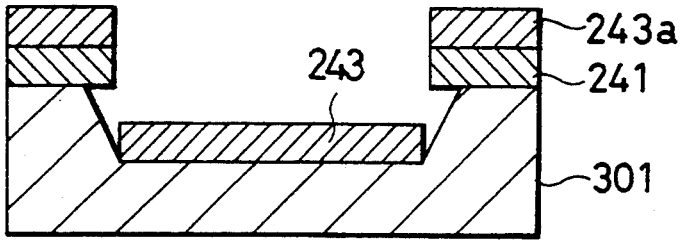
Figure 24D:
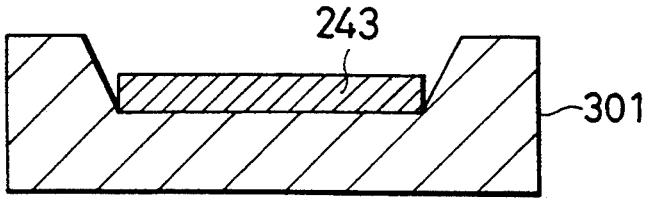

Then, the silicon substrate 301 exposed out to the surface is removed by the wet etching technique with a mixed liquid of hydrofluoric acid, nitric acid, and acetic acid. As a result, a concave portion 242 with a flat bottom having a depth of about 5 μm is formed in the silicon substrate 301. And, by depositing the electron collect electrode (anode) material vertically with respect to the concave portion 242, as shown in FIG. 24C, the electron collect electrode 243 is formed on the bottom of the concave portion 242. Herein, the material for the electron collect electrode uses niobium (Nb) and has a thickness of about 2500 Å. When manufacturing the electron collect electrode 243, a niobium (Nb) layer **243*a* deposited on the silicon thermal oxidized layer ($SiO_2$ layer) pattern 241 is removed by the lift-off technique, concretely, by removing the silicon thermal oxidized layer ($SiO_2$ layer) pattern 241. The resulting structure is a structure containing the electron collect electrode 248 as shown in FIG. 24B. With this process, the joint substrate is manufactured. The wiring portion of the electron collect electrode 243** for the joint substrate is formed in a manner to allow the wiring portion to pass on the joint portion and be pulled out to the external.

In this embodiment, by using silicon as the material for the joint substrate, the material is not limited to this. In practice, it is possible to use an insulating material, semiconductor or metal having at least an oxidizable element or a material containing the oxidizable element at the sealed joint portion. If the metal is used for the joint metal, the metal may be the electron collect electrode. The material for the electron collect electrode is not limited to this material. It is possible to use as the material metal such as molybdenum (Mo), tungsten (W), chromium (Cr), titanium (Ti), zirconium (Zr), aluminum (Al), nickel (Ni), or copper (Cu), or an alloy or a lamination film made of those metals together with niobium (Nb). Further, the thickness of the film is not limited to the value described as above.

If the electron tube is used for a display, a transparent substrate made of glass is used for the joint substrate. After a transparent conductive film material is formed as a film for the electron collect electrode on the glass substrate. Then, on the film, there is formed a fluorescent layer.

The vacuum area enclosing the electrode structure of the electron emitting device according to this embodiment is formed by jointing the spacer provided on the outer peripheral portion of the electrode structure in a vacuum bath with the outer peripheral portion of the joint substrate, like the fifth embodiment.

As for the display referred to as a utilization field, the structure of the vacuum-sealed portion is supplemented in the description. In general, the electrode structure of the display is that as shown in FIG. 3 if it is expanded. And, as described with respect to the first embodiment, as shown in FIG. 3, as the substrate 1, a transparent substrate, for example, a glass substrate is used. On the electron collect electrode 8, a fluorescent layer is formed. Between the electron collect electrode 8 and the fluorescent layer, a filter layer may be provided as means for color display. The fluorescent material operates to emit light when electrons emitted from the electron emitting source 91 come into the fluorescent layer. This emitted light is controlled to operate an image on the display.

Figure 25:
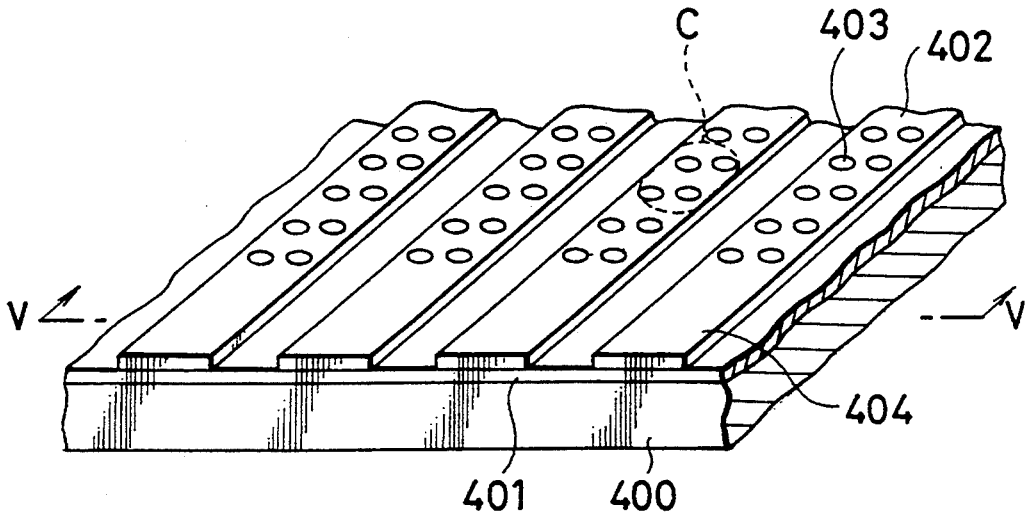
FIG. 25 is a perspective view for explaining gate lines.
Figure 26:
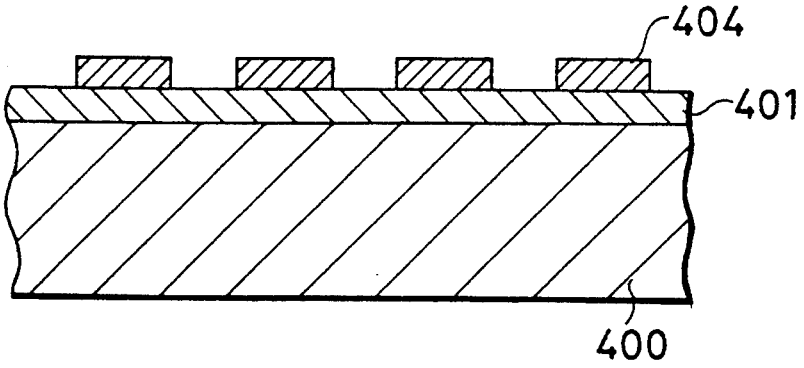
FIG. 26 is a sectional view showing a joint portion cut on the line V—V of FIG. 25 when sealing the structure in vacuum.
Figure 27:
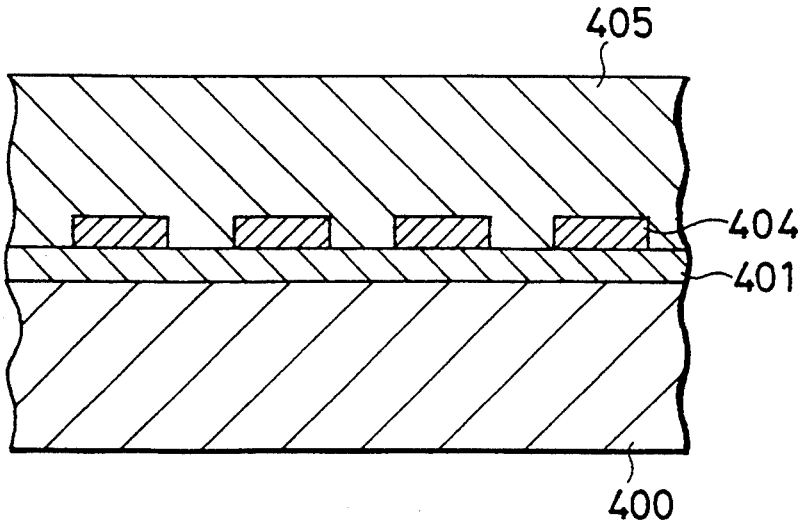
FIG. 27 is a sectional view showing a spacer added to the joint portion shown in FIG. 26.
Figure 28:
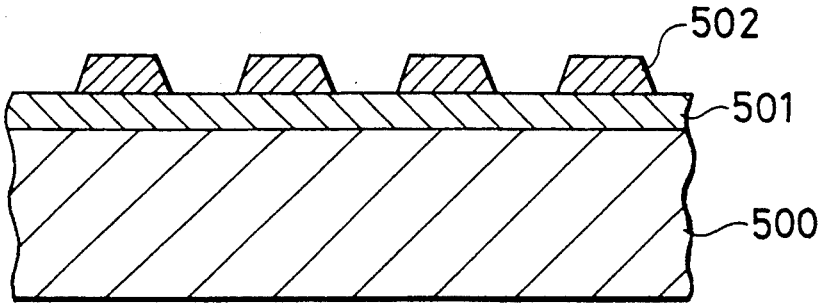
FIG. 28 is a sectional view for explaining a form of an tapered electrode line.

In this field, as a driving method for making any desired pixel luminous, the X-Y matrix addressing method is mainly used. For that purpose, it is possible to form an X-Y matrix structure where each of a plurality of gate lines formed by electrically dividing the electrode for picking up an electron beam as parallel lines is crossed with each of a plurality of electron collect electrode lines formed by electrically dividing the electron collect electrode as parallel lines or another X-Y matrix structure where each of the gate lines is crossed with each of a plurality of cold cathode array lines formed by electrically dividing the cold cathode electrode as parallel lines. If any one of these X-Y matrix structures is formed, it is necessary to make the electrode for picking up an electron beam the gate lines electrically divided as parallel lines. FIG. 25 is an explanatory view showing the gate lines. An expanded view of a part C enclosed by a dotted line of FIG. 25 corresponds to FIG. 3. That is, 400 denotes a substrate for supporting the cold cathode array. Item 401 denotes an electrically insulated layer 402 denotes the gate line and 403 denotes an aperture from which the electron emitting source is exposed. The plurality of gate lines are formed in parallel and the number of the electron emitting sources located on one gate line area is 2 in the width direction as shown in FIG. 25. The number is not limited to this. Any number of electron emitting sources may be used. On the viewer's side of the gate lines of FIG. 25, there exists an area 404 where no aperture 403 is formed. This corresponds to an outer peripheral portion of the display area and is used as a joint portion when implementing the vacuum sealing. FIG. 26 is a sectional view showing a joint portion cut on the line V—V of FIG. 25 when implementing the vacuum sealing. As shown in FIG. 26, the joint portion is rugged because the gate lines are formed. Hence, it is difficult to joint the foregoing electron collect electrode with the joint portion of the glass substrate having the fluorescent layer in vacuum. In such a case, as described in the fourth, the fifth, and the sixth embodiments, as shown in FIG. 27, there is provided a spacer 405 composed of an electrically insulated material. The spacer material contains an alkali metal element and an oxygen element. For example, it is possible to use Pyrex glass, normal glass, soft glass, ceramics, silicon oxide containing the alkali metal element or silicon nitride containing the alkali metal element. The joint portion of the glass substrate having the electron collect electrode and the fluorescent layer formed thereon is composed of an oxidizable element or a material containing the oxidizable element. Further, when jointing them, it is also possible to use a gate line 404 as a negative voltage electrode for the spacer 405. Without being limited to the display, if the electrodes are located as indicated in the fifth and the sixth embodiments and FIG. 26, at least an electrode form of the joint portion is made tapered as shown in FIG. 28. In this case, the essential thickness of the spacer may be effectively made thinner than the electrode having no tapered form. FIG. 28 is a sectional view in which 500 denotes a substrate for the cold cathode array, 501 denotes an electrically insulated layer, and 502 denotes an electrode line.

Figure 29:
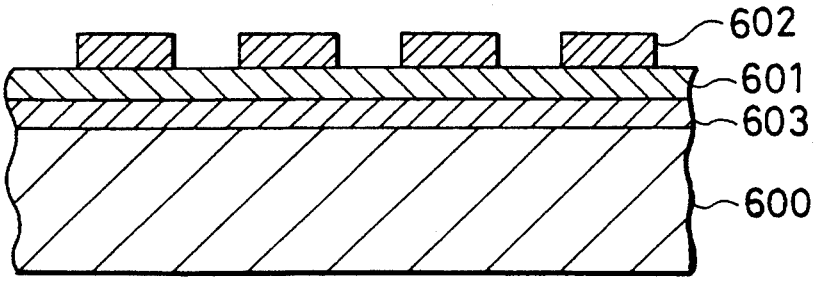
FIG. 29 is a sectional view for explaining a structure where an electrode layer for jointing is provided.
Figure 30:
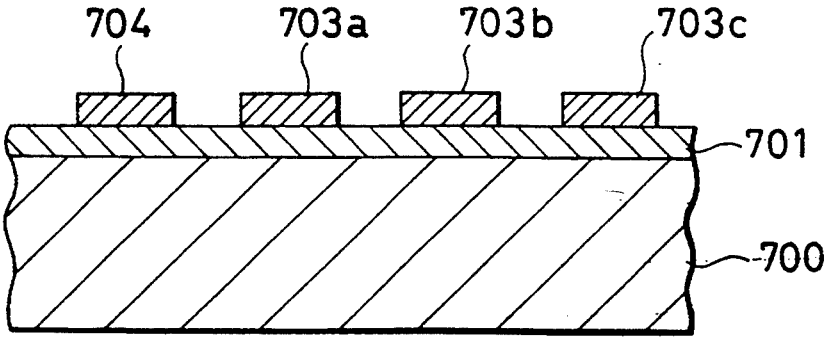
FIG. 30 is a sectional view for explaining the structure where an electrode layer for jointing is provided.

If the electrodes are located as shown in FIGS. 15 and it is possible to take a structure as shown in FIG. 29. The spacer for jointing and sealing the substrates in vacuum is formed to cover the exposed portion of the joint portion between the electrode line 602 and the electrically insulated layer 601. As a feature, an electrode layer 603 for applying a necessary negative voltage for jointing to this spacer is formed on a substrate 600 for supporting the cold cathode array. This electrode 603 may be formed on the overall surface of the substrate 600 for supporting the cold cathode array or on the partial surface of the substrate 600. As another method for providing an electrode layer for applying a necessary voltage to the joint, for example, when forming at least one of the cold cathode array, the electrode for picking up an electron beam, and the electron collect electrode, the electrode may be formed in any form on the same surface with the electrode being electrically insulated from the other electrodes. The section of the joint portion if any one electrode is formed is as shown in FIG. 30, in which 703*a*, 703*b*, and 703*c* are any one of the cold cathode array, the electrode for picking up an electron beam, and the electron collect electrode. Item 704 denotes an electrode layer for applying a necessary voltage when jointing the substrates, 700 denotes a substrate for supporting an electrode and 701 denotes an electrically insulated layer. In this case, on the exposed surfaces of these electrodes (709*a*, 703*b*, 703*c*, 704), of course, the spacer is provided for forming the joint portion.

As a main spacer material in this embodiment, as described above, the alkali metal element and the oxygen element are contained in the material. It is not limited to this. For example, the material may contain no alkali metal. The main materials checked by use are flit glass (main components $PbO$-$ZnO$-$B_2O_3$), silicon oxide ($SiO$, $SiO_2$, etc.), silicon nitride ($SiN$, etc.), silicon oxide and nitride ($SiON$, etc.), that is, an oxidizable element or the material containing the oxidizable element. In this case, on the other substrate to be jointed with the spacer for sealing the substrates in vacuum, the surface of at least the joint portion is made of a material containing the alkali metal element and the oxygen element. The electrode for a voltage to be applied for jointing is located so that its positive electrode is provided on the spacer side and its negative electrode is provided on the joint portion of the other side.

As discussed above in detail, the electron emitting device according to the present invention is manufactured to be very short, small light and thin, because the dimension of the electrode structure composed of two substrates for supporting the cold cathode array and the electron collect electrode corresponds to the dimension of the electron tube.

Further, for example, if the joint portion is structured to laminate an outer peripheral portion of the first substrate, an outer peripheral portion of the insulated layer for electrically insulating the electrode for picking up an electrode beam and the first substrate, an outer peripheral portion of the electrode for picking up an electron beam, and an outer peripheral portion of the second substrate, preferably, in the joint portion, one of the second substrate and the electrode for picking up an electrode beam is made of a material containing an alkali metal element and an oxygen element and the other is made of an oxidizable element or a material containing the oxidizable element. Hence, without using a sealing member as the joint portion and without melting the joint portion, the joint (anode joint) is allowed to be done by applying only heat and voltage. This results in making it possible to perform sealing in highly vacuum with no generation of gas.

In this electron emitting device, since the sealing member is not used for vacuum sealing, like the first to the sixth embodiments, no change takes place about a distance between the substrate for supporting the cold cathode array and the substrate for supporting the electron collect electrode. For that purpose, it is possible to efficiently control the distance between the tip of the electron emitting portion included in the electron emitting source and the electron collect electrode. Under the control of the distance, the distance is made shorter than an average free stroke of electrons.

As described above, the electron emitting device according to the present invention can be used as a high-performance vacuum or display. Further, this device makes it possible to manufacture an electron emitting device which may perform a larger output and higher efficiency than the comparable GaAs device, though it is far shorter, smaller, lighter and thinner than the GaAs device.

Many widely different embodiments of the present invention may be constructed without departing from the spirit and scope of the present invention. It should be understood that the present invention is not limited to the specific embodiments described in the specification, except as defined in the appended claims.

What is claimed is:

1. An electron emitting device comprising:

a first substrate;

a second substrate located as opposed to said first substrate;

a cold cathode array composed of a plurality of electron emitting sources for emitting electrons based on a principle of electric field emission;

an electrode electrically insulated from said cold cathode array and for picking up an electron beam; and an electron collect electrode insulated from said cold cathode array and said electrode for picking up an electron beam, an outer peripheral portion of at least said first substrate being jointed to an outer peripheral portion of said second substrate in a manner to keep an electron emission space, defined by at least said cold cathode array, said electrode for picking up an electron beam and said electron collect electrode, in vacuum.

one of the portions which are jointed to each other at the jointing portion comprising a material containing an alkaline metal element and an oxygen element and the other portion comprising an oxidizable element or a material containing an oxidizable element.

2. An electron emitting device as described in claim 1, wherein said cold cathode array is formed on said first substrate, said electrode for picking up an electron beam is formed around said cold cathode array formed on said first substrate, and said electron collect electrode is formed on said second substrate as opposed to said cold cathode array and said electrode for picking up an electron beam.

3. An electron emitting device as described in claim 2, wherein at least a joint surface of one of said first substrate and said second substrate jointed to each other is composed of a material containing an alkali metal element and an oxygen element and at least a joint surface of the other of said first and second substrates is composed of an oxidizable element or a material containing the oxidizable material.

4. An electron emitting device as described in claim 2, wherein the outer peripheral portion of said first substrate, an outer peripheral portion of an insulated layer for electrically insulating said electrode for picking up an electron beam and said first substrate, an outer peripheral portion of said electrode for picking up an electron beam, and an outer peripheral portion of said second substrate are jointed to one another in a manner to keep said electron emission space defined by at least said cold cathode array, said electrode for picking up an electron beam, and said electron collect electrode in vacuum.

5. An electron emitting device as described in claim 4, wherein one of at least the joint surface of said second substrate and said electrode for picking up an electron beam is composed of a material containing an alkali metal element and an oxygen element and the other is composed of an oxidizable element or a material containing the oxidizable element.

6. An electron emitting device as described in claim 2, wherein the outer peripheral portion of said first substrate, an outer peripheral portion of an insulated layer for electrically insulating said electrode for picking up an electron beam and said first substrate, and an outer peripheral portion of said second substrate are jointed to one another in a manner to keep said electron emission space defined by at least said cold cathode array, said electrode for picking up an electron beam, and said electron collect electrode in vacuum.

7. An electron emitting device as described in claim 6, wherein one of at least the joint surface of said second substrate and said insulated layer is composed of a material containing an alkali metal element and an oxygen element and the other is composed of an oxidizable element or a material containing the oxidizable element.

8. An electron emitting device as described in claim 2, wherein the outer peripheral portion of said first substrate, an outer peripheral portion of an insulated layer for electrically insulating said electrode for picking up an electron beam and said first substrate, an outer peripheral portion of said electrode for picking up an electron beam, a spacer provided for jointing, an outer peripheral portion of said electron collect electrode and an outer peripheral portion of said second substrate are jointed to one another in a manner to keep said electron emission space defined by at least said cold cathode array, said electrode for picking up an electron beam, and said electron collect electrode in vacuum.

9. An electron emitting device as described in claim 8, wherein one of said joint spacer and said electrode for picking up an electron beam is composed of a material containing an alkali metal element and an oxygen element and the other is composed of an oxidizable element or a material containing the oxidizable element.

10. An electron emitting device as described in claim 8, wherein one of said joint spacer and said electron collect electrode is composed of a material containing an alkali metal element and an oxygen element and the other is composed of an oxidizable element or a material containing the oxidizable element.

11. An electron emitting device as described in claim 8, wherein said spacer is a thin film composed of an electrically insulating material formed on said electrode for picking up an electron beam and said electron collect electrode.

12. An electron emitting device as described in claim 1, wherein at least one surface of said first substrate is insulated and said cold cathode array and said electrode for picking up an electron beam are formed on the insulated surface of said first substrate as a plurality of lines.

13. An electron emitting device as described in claim 12, wherein together with said cold cathode array and said electrode for picking up an electron beam, said electron collect electrode is formed on an insulated surface of said first substrate as a plurality of lines.

14. An electron emitting device as described in claim 12, wherein said electron collect electrode is formed on said second substrate.

15. An electron emitting device as described in claim 14, wherein one of at least the joint surface of said first substrate and said spacer is composed of a material containing an alkali metal element and an oxygen element and the other is composed of an oxidizable element or a material containing the oxidizable element.

16. An electron emitting device as described in claim 14, wherein one of at least the joint surface of said second substrate and said spacer is composed of a material containing an alkali metal element and an oxygen element and the other is composed of an oxidizable element or a material containing the oxidizable element.

17. An electron emitting device as described in claim 12, wherein the outer peripheral portion of said first substrate, said insulated spacer provided for jointing, and the outer peripheral portion of said second substrate are jointed in a manner to keep the electron emission space defined by at least said cold cathode array, said electrode for picking up an electron beam, and said electron collect electrode in vacuum.

18. An electron emitting device as described in claim 17, wherein a wiring portion is provided at at least one end of each of a plurality of lines formed as said cold cathode array and said electrode for picking up an electron beam, on the outer peripheral portion of said first substrate, and at each wiring portion of said cold cathode array and said electrode for picking up an electron beam, the outer peripheral portion of said first substrate is jointed to said spacer and said second substrate.

19. An electron emitting device as described in claim 17, wherein a wiring portion is provided at at least one end of each of a plurality of lines formed as said electrode for picking up an electron beam and said electron collect electrode on the outer peripheral portion of said first substrate, and at each wiring portion of said electrode for picking up an electron beam, and said electron collect electrode, the outer peripheral portion of said first substrate is jointed to said spacer and said second substrate.

20. An electron emitting device as described in claim 1, wherein on at least one of said substrates or structures formed on said substrates, an electrode layer is provided for applying a necessary voltage for jointing to a proper portion.

* * * * *